US009803360B2

(12) United States Patent
Gosling

(10) Patent No.: US 9,803,360 B2
(45) Date of Patent: Oct. 31, 2017

(54) SELECTIVELY ADJUSTABLE ARCHITECTURAL WALL

(71) Applicant: DIRTT Environmental Solutions, Ltd., Calgary (CA)

(72) Inventor: Geoff Gosling, Calgary (CA)

(73) Assignee: DIRTT Environmental Solutions, LTD., Calgary (CA)

( * ) Notice: Subject to any disclaimer, the term of this patent is extended or adjusted under 35 U.S.C. 154(b) by 0 days.

(21) Appl. No.: 14/376,821

(22) PCT Filed: Nov. 13, 2013

(86) PCT No.: PCT/US2013/069923
§ 371 (c)(1),
(2) Date: Aug. 5, 2014

(87) PCT Pub. No.: WO2014/078437
PCT Pub. Date: May 22, 2014

(65) Prior Publication Data

US 2015/0013243 A1 Jan. 15, 2015

Related U.S. Application Data

(60) Provisional application No. 61/725,920, filed on Nov. 13, 2012.

(51) Int. Cl.
*E06B 3/54* (2006.01)
*E04B 2/74* (2006.01)
(Continued)

(52) U.S. Cl.
CPC ..... *E04B 2/74* (2013.01); *E04B 2/7448* (2013.01); *E04B 2/82* (2013.01); *E04B 2/825* (2013.01); *E04B 9/008* (2013.01); *E06B 3/5454* (2013.01)

(58) Field of Classification Search
CPC .. E04B 2/828; E04B 9/008; E04B 2002/7492; E06B 3/5454; E06B 3/5864; E06B 3/5857
(Continued)

(56) References Cited

U.S. PATENT DOCUMENTS 1,664,827 A * 4/1928 Nicholay ..... E04B 1/4135 52/223.13
2,610,369 A * 9/1952 Huizenga ..... E06B 3/5409 52/126.3
(Continued)

FOREIGN PATENT DOCUMENTS

JP 55102820 A * 8/1980
JP 02104829 A * 4/1990
(Continued)

OTHER PUBLICATIONS

International Search Report and Written Opinion for PCT/US2013/069923 mailed Feb. 18, 2014.

*Primary Examiner* — Robert Canfield
(74) *Attorney, Agent, or Firm* — Workman Nydegger

(57) ABSTRACT

Apparatus, systems, and methods for constructing and installing architectural walls that are secured to a floor and/or a ceiling and that that include an adjustment mechanism. The adjustment mechanism may allow the architectural wall to be selectively adjusted horizontally relative to the floor and/or ceiling so that a vertical positioning of the wall may be achieved. The adjustment mechanism may also allow the architectural wall to fit securely to a floor and/or ceiling.

13 Claims, 13 Drawing Sheets

(51) Int. Cl.
*E04B 9/00* (2006.01)
*E04B 2/82* (2006.01)

(58) Field of Classification Search
USPC ..... 52/126.3, 126.4, 238.1, 241, 126.1
See application file for complete search history.

(56) References Cited

U.S. PATENT DOCUMENTS 2,633,735 A * 4/1953 Dondero ..... E04F 13/0853 411/427
3,127,703 A * 4/1964 Eshelman ..... E04F 21/05 52/365
3,256,668 A * 6/1966 Downes ..... E04B 2/789 52/242
3,315,424 A * 4/1967 Smith ..... E04B 1/161 264/35
3,340,655 A * 9/1967 Darrah, Jr. ..... E04B 2/821 52/143
3,404,501 A * 10/1968 Von Wedel ..... E06B 3/5409 52/126.4
3,436,892 A * 4/1969 Slavin ..... E04B 1/043 52/747.12
3,628,299 A * 12/1971 Nakazawa ..... E04B 1/4107 52/506.06
3,640,043 A * 2/1972 Querfeld ..... E04F 13/0808 52/235
3,696,560 A * 10/1972 Hallin ..... E05D 15/0634 16/105
3,913,287 A * 10/1975 Chapman, Jr. ..... E04B 5/06 248/201
3,924,369 A 12/1975 Guarino
4,054,268 A * 10/1977 Sher ..... E04F 11/1851 256/24
4,182,092 A * 1/1980 Weaver ..... E04B 1/043 52/584.1
4,188,758 A * 2/1980 Swann ..... E04B 2/824 52/241
4,211,046 A * 7/1980 Shahan ..... E04B 1/86 248/613
4,433,516 A * 2/1984 Fricker ..... E04F 13/0892 52/126.3
4,558,850 A * 12/1985 Melfi ..... E01F 8/0017 181/210
4,627,527 A * 12/1986 Saito ..... B66B 23/22 198/335
4,644,711 A * 2/1987 Eickhof ..... E04H 13/006 52/126.7
4,662,128 A * 5/1987 Eberdt ..... E04B 2/7845 52/243
4,819,781 A * 4/1989 Saito ..... B66B 23/22 198/335
5,067,292 A * 11/1991 Finean ..... E04F 13/0855 52/126.4
5,309,691 A * 5/1994 Tolliver ..... E01D 19/125 138/155
5,444,945 A * 8/1995 Goodwin ..... E04F 13/081 292/199
6,052,958 A * 4/2000 Miedema ..... E04B 2/7437 52/239
6,609,350 B1 * 8/2003 Weber ..... B32B 17/10036 52/784.1
7,559,536 B1 * 7/2009 Hansen ..... E04F 11/1851 256/25
8,186,917 B2 * 5/2012 Nelson ..... B60P 3/205 410/129
8,500,110 B2 * 8/2013 Allen ..... E04F 11/1851 269/297
8,549,817 B2 * 10/2013 Burke ..... A47F 3/12 52/716.8
8,640,399 B2 * 2/2014 Fradera Pellicer ..... B28B 5/04 52/124.2
8,826,621 B2 * 9/2014 Noble ..... E04F 11/1851 52/584.1
8,833,018 B2 * 9/2014 Reinecke ..... E04F 11/1812 248/181.1
9,169,640 B2 * 10/2015 Jeffers ..... E04B 2/7422
9,453,357 B1 * 9/2016 Bertato ..... E04H 17/16
2002/0062617 A1 * 5/2002 diGirolamo ..... E04B 2/767 52/688
2006/0097237 A1 * 5/2006 McGregor ..... E01F 13/022 256/24
2008/0295426 A1 * 12/2008 Milligan ..... E06B 1/6076 52/238.1
2010/0225040 A1 * 9/2010 Allen ..... E04F 11/1851 269/297
2011/0138719 A1 * 6/2011 Gosling ..... E04B 2/7405 52/284
2011/0146181 A1 * 6/2011 Traulsen ..... E04B 2/94 52/474
2011/0239560 A1 * 10/2011 Landeros ..... E06B 3/305 52/204.61
2012/0261631 A1 * 10/2012 Schopf ..... E04F 11/1851 256/24
2013/0036680 A1 * 2/2013 Noble ..... E04F 11/1851 52/126.4
2016/0160512 A1 * 6/2016 Brown ..... E04F 21/1877 52/126.4

FOREIGN PATENT DOCUMENTS

JP 04-083038 3/1992
JP 04363452 A * 12/1992
JP 07-300920 11/1995
JP 09-060174 3/1997
KR 20-1996-0031913 10/1996

* cited by examiner

SELECTIVELY ADJUSTABLE ARCHITECTURAL WALL

CROSS-REFERENCE TO RELATED APPLICATIONS

This application is a 35 U.S.C. §371 U.S. National Stage of PCT Application No. PCT/US2013/069923 filed Nov. 13, 2013 entitled SELECTIVELY ADJUSTABLE ARCHITECTURAL WALL which claims priority to U.S. Provisional Patent Application Ser. No. 61/725,920, filed 13 Nov. 2012, and entitled SELECTIVELY ADJUSTABLE ARCHITECTURAL WALL. The entire content of each of the aforementioned patent applications is incorporated herein by reference.

BACKGROUND OF THE INVENTION

1. The Field of the Invention

Generally, this invention relates to architectural walls. More specifically, the present invention relates to architectural walls that allow for selective adjustment relative to a ceiling, floor, or both.

2. Background and Relevant Art

Architects and interior designers often use walls to separate space within an indoor environment, such as a home, an office, or another building. Some indoor environments have raised floor structures that are lifted above a floor surface. For example, some office buildings may include raised floors that lie above a sub floor. Similarly, some indoor environments may have suspended ceilings that are hung or suspended from a ceiling. One advantage of having raised floors and/or suspended ceilings is that they provide space for power cables, communication cables, and other unsightly hardware between the raised floor and sub floor or between a suspended ceiling and a ceiling. Thus, suspended ceilings and raised floors can hide cables, HVAC, or other building infrastructure from view.

Securing an architectural wall within an indoor environment that has a raised floor and a suspended ceiling can be challenging. For example, suspended ceilings and raised floors may not provide sufficient structural support to be used as anchor points for top and/or bottom ends of an architectural wall. Thus, architectural walls may extend below a raised floor to be anchored to a floor and/or above a suspended ceiling to be anchored to a ceiling.

While a floor and a ceiling may provide adequate structural support for anchoring a top and/or bottom end of an architectural wall, using a floor and/or a ceiling as anchor points has its own challenges. Channels that house opposite ends of an architectural wall may be cut out of or attached to a floor and/or ceiling. Unfortunately, it can be difficult or even impossible to perfectly align such channels or even walls within the channels.

Thus, there are a number of problems with architectural walls that can be addressed.

BRIEF SUMMARY OF THE INVENTION

Implementations of the present invention solve one or more of the foregoing or other problems in the art with apparatuses, systems, and methods for constructing and installing architectural walls that are secured to a floor and/or a ceiling and that include an adjustment mechanism. The adjustment mechanism may allow the architectural wall to be selectively adjusted relative to the floor and/or ceiling such that a vertical positioning of the wall may be achieved.

The adjustment mechanism may also allow the architectural wall to fit securely to a floor and/or ceiling, by eliminating or reducing any side-to-side movement in the installed wall.

One or more implementations may include an architectural wall system comprising a wall and an adjustment mechanism attached between a first end of the wall and a permanent structure that allows the wall to be adjusted in position relative to the permanent structure.

At least one implementation comprises a method for adjusting the position of an architectural wall, the method comprising securing a first end of the architectural wall to a permanent structure via at least one adjustment mechanism and selectively adjusting a position of the first end of the architectural wall via the adjustment mechanism such that a positioning of the architectural wall is achieved.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

One or more implementations of the present invention relate to constructing and installing architectural walls that are secured to a floor and/or a ceiling and that include an adjustment mechanism. The adjustment mechanism may allow the architectural wall to be selectively adjusted horizontally relative to the floor and/or ceiling so that a vertical positioning of the wall may be achieved. The adjustment mechanism may also allow the architectural wall to fit securely to a floor and/or ceiling, eliminating or reducing any side-to-side movement in the installed wall.

Figure 1:
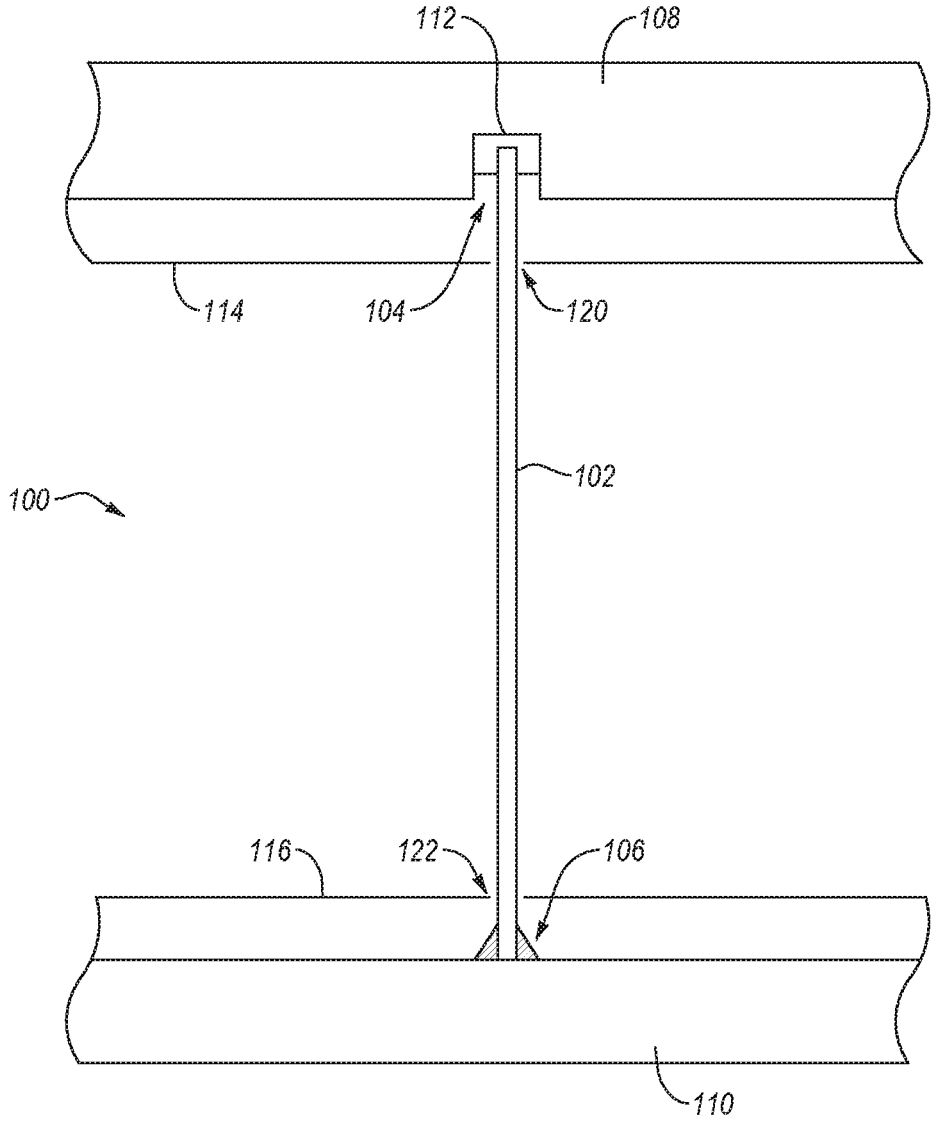
FIG. 1 illustrates an end view of an architectural wall and securing mechanism according to an implementation of the present invention.

FIG. 1 illustrates an end view of an architectural wall system 100. Architectural wall system 100 includes a wall 102, an adjustment mechanism 104, and a support member 106. Wall 102 is secured between two permanent structures. Specifically, wall 102 is secured between a ceiling 108 and a floor 110. The ceiling 108 has a channel 112 extending therein. In alternative implementations, the channel 112 can comprise a channel secured to the ceiling rather than a channel extending into the ceiling. In any event, the wall 102 may fit partially within the channel 112.

The wall 102 may comprise any suitable material. For example, the wall 102 may comprise or be composed entirely or in part of gypsum plaster, wood, metal, or another material. The wall 102 may be a modular wall or a permanent wall. In at least one implementation the wall 102 comprises a modular wall. The modular wall can include a frame and tiles or panels that removably attach to the frame such as those disclosed in U.S. Pat. No. 8,024,901, titled Integrated Reconfigurable Wall System, the contents of which are hereby incorporated by reference in their entirety.

In one or more implementations, the wall 102 extends above a drop down ceiling 114, through an appropriately sized hole 120 in the drop down ceiling. For example, the drop down ceiling 114 may include a rectangular hole or channel that has approximately the same dimensions as the wall 102 so that no significant gaps between the drop down ceiling 114 and the wall 102 exist. The wall 102 can also extend below a raised floor 116, through an appropriately sized hole 122 in the raised floor. For example, the raised floor 116 may include a rectangular hole or channel that has approximately the same dimensions as the wall 102 so that no significant gaps between the raised floor 116 and the wall 102 exist.

Figure 2:
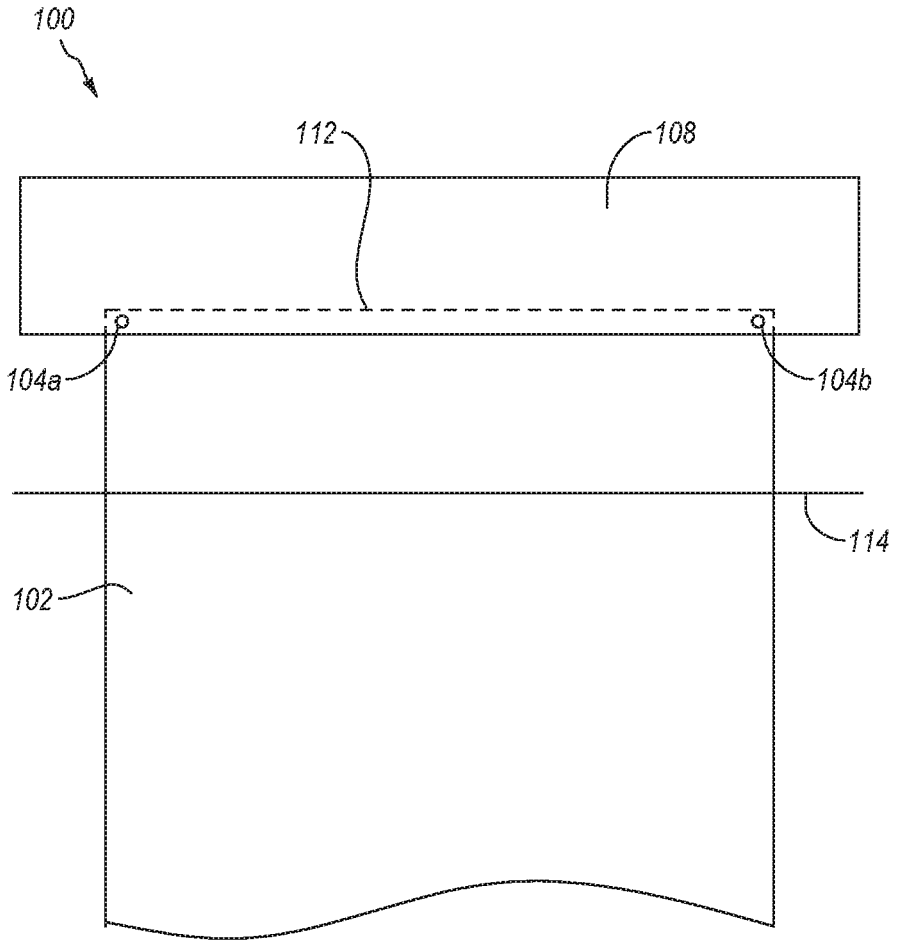
FIG. 2 illustrates a side view of an architectural wall according to an implementation of the present invention.

One will appreciate that the depth of channel 112 can vary. For example, in one implementation, the channel 112 may be less than an inch or so deep. In other implementations, the depth of the channel 112 can be six or more inches. The channel 112 may extend into the permanent structure (such as a floor or ceiling). Alternatively, the channel 112 can comprise a structure attached to the permanent ceiling structure. In any event, the channel 112 may extend the entire length of wall 102 or only a portion or portions thereof. For example, FIG. 2 illustrates a side view of the architectural wall system 100. As can be seen in FIG. 2, the channel 112 extends the length of the wall 102. Thus, channel 112 houses a portion of the wall 102 along the entire top edge of wall 102. In alternative implementations, two or more channels may house portions of the top edge of a wall.

Channel 112 can also house the adjustment mechanisms 104*a* and 104*b*. In alternative implementations, adjustment mechanisms may not be positioned within the channel 112. The adjustment mechanisms 104*a* and 104*b* may be any mechanism that allows selective adjustment of the wall 102 relative to the ceiling 108. The adjustment mechanisms 104*a* and 104*b* may also secure, or help secure, the wall 102 to the ceiling 108. A number of different adjustment mechanisms may accomplish one or more of these, or other purposes.

Figure 3A:
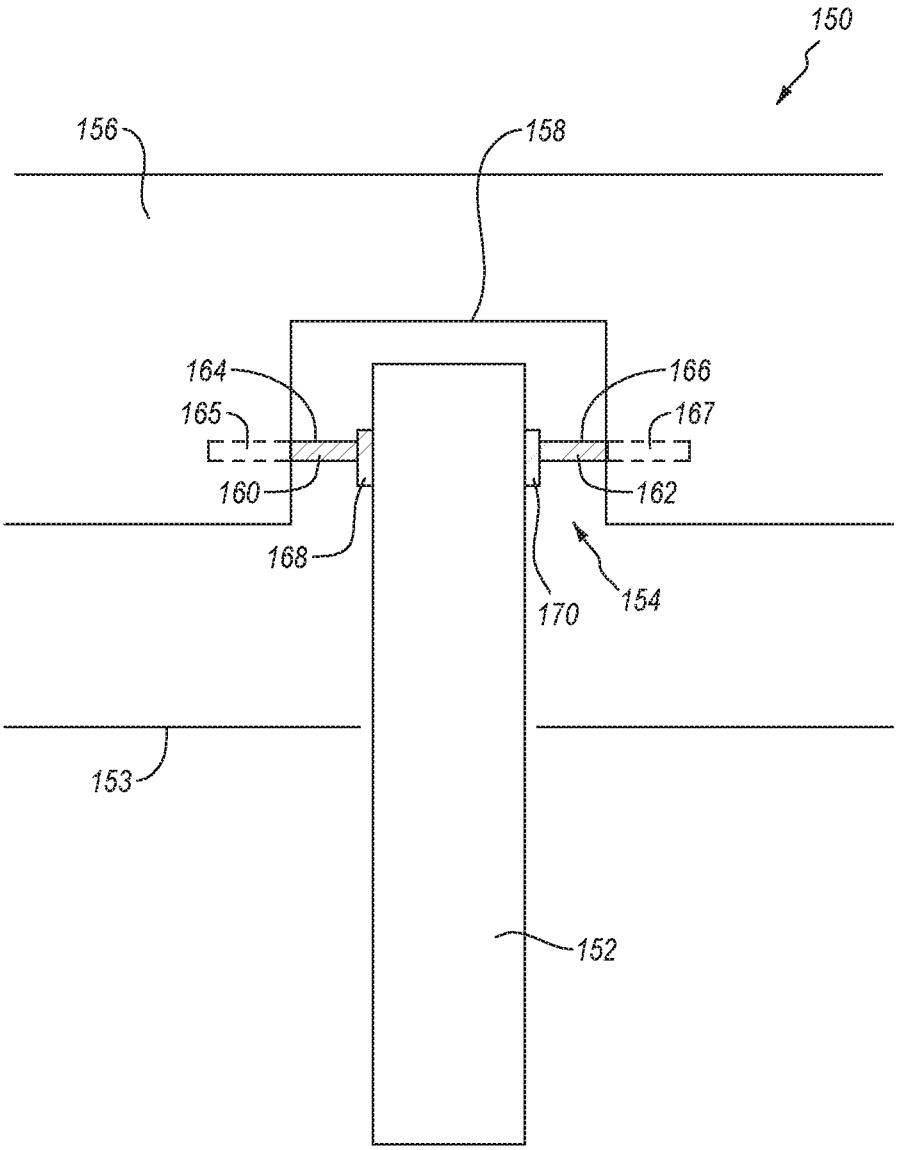
FIG. 3A illustrates an end-sectional view of a first securing mechanism according to an implementation of the present invention in a first position.

For example, FIG. 3A illustrates one implementation of an adjustment mechanism according to the present invention. FIG. 3A illustrates an architectural wall system 150, which includes a wall 152 and an adjustment mechanism 154. A portion of wall 152 extends above a suspended ceiling 153 and into a channel 158 in a ceiling 156. The adjustment mechanism 154 comprises a pair of screws 160 and 162, which are positioned within channel 158 and on opposite sides of wall 152. One end of the screws 160 and 162 include threaded portions 164 and 166. Threaded portions 164 and 166 of screws 160 and 162 mate with holes 165 and 167 in the ceiling 156 and on opposite sides of the channel 158. The screws 160 and 162 also include support portions 168 and 170. By rotating the screws 160 and 162 within the holes 165 and 167, one can selectively adjust the placement of the support portions 168 and 170 within the channel 158.

The wall 152 can extend into the channel 158 such that the screws 160 and 162 are positioned on either side of the wall 152. The ability to selectively adjust the placement of the support portions 168 and 170 within the channel 158 allows a person to secure the wall 152 between the screws 160 and 162 by pinching the wall between the screws 160 and 162 and/or support portions 168 and 170. In addition, the ability to selectively adjust the placement of the support portions 168 and 170 within the channel 158 allows a person to selectively alter the position of the wall 152 within the channel 158 and relative to the ceiling 156.

Figure 3B:
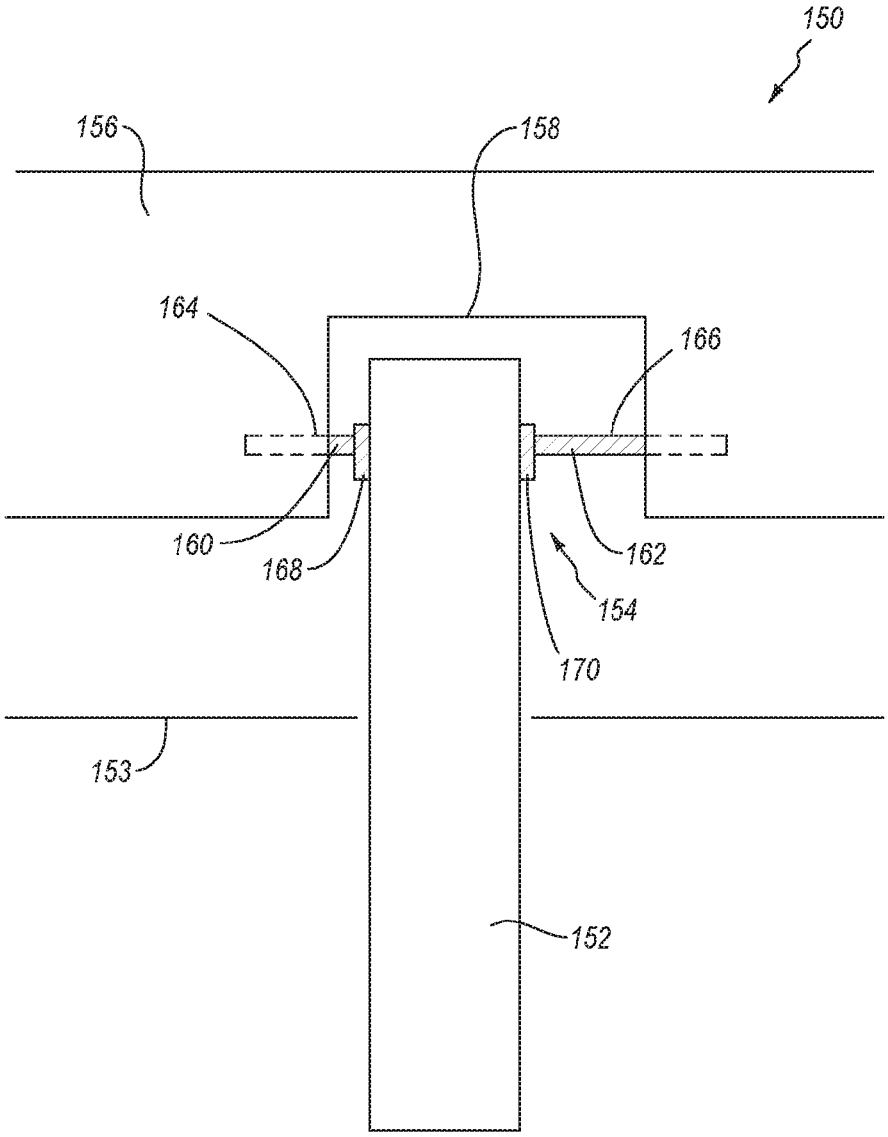
FIG. 3B illustrates an end-sectional view of the first securing mechanism of FIG. 3A in a second position.
Figure 3C:
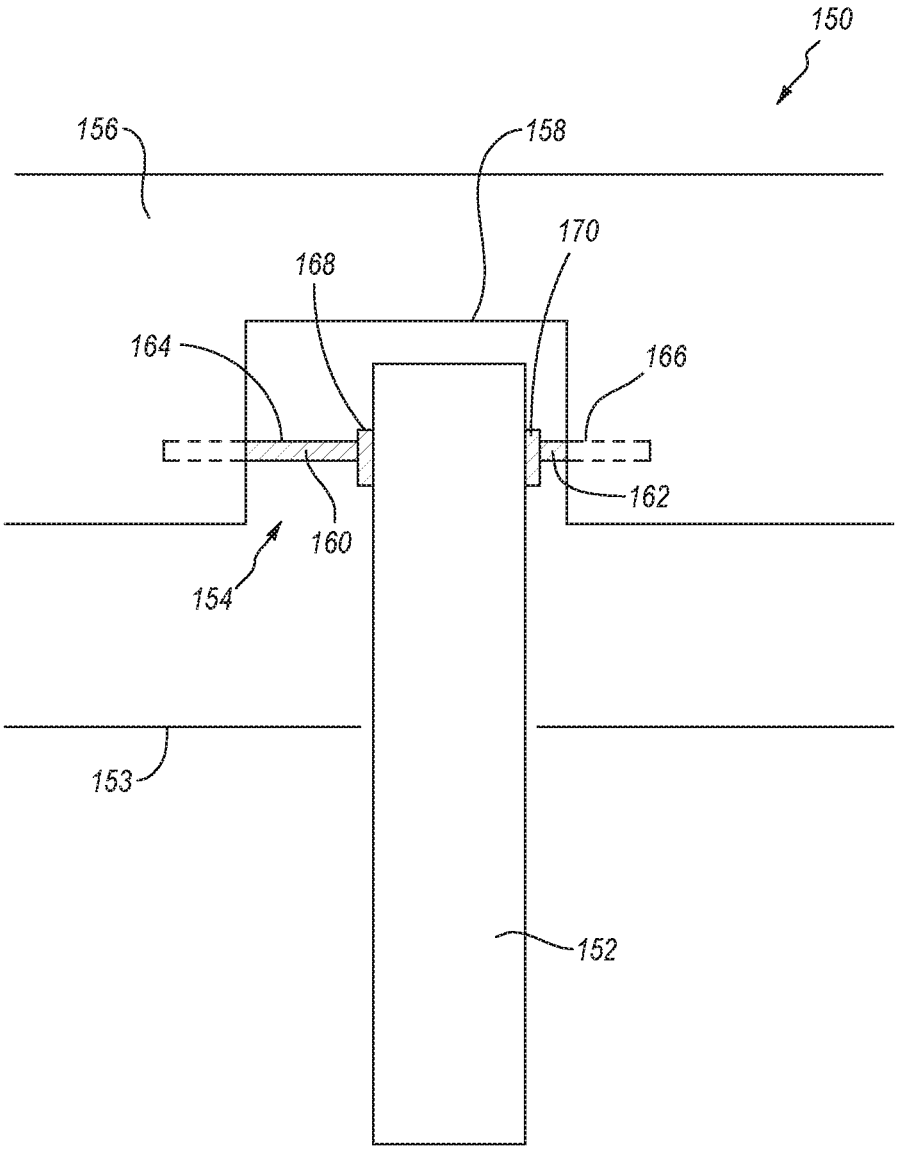
FIG. 3C illustrates an end-sectional view of the first securing mechanism of FIG. 3A in a third position.

For example, FIG. 3B illustrates architectural wall system 150 where screws 160 and 162 have been rotated so that they are positioned such that wall 152 is secured within channel 158 near the left side of the channel 158. Likewise, FIG. 3C illustrates architectural wall system 150 where screws 160 and 162 have been rotated so that they are positioned such that wall 152 is secured within channel 158 near the right side of the channel 158. Adjusting the position of wall 152 within channel 158 in this manner may allow any pitch or non-vertical angle in wall 152 to be corrected. In each of FIGS. 3A-3C, wall 152 is frictionally secured in place between screws 160 and 162. One will appreciate, however, that other mechanism of or for securing wall 152 in place are contemplated herein; for example, adhesives, impalements, engagements, and gravitational mechanisms may also or alternatively be applicable in certain implementations.

Figure 4:
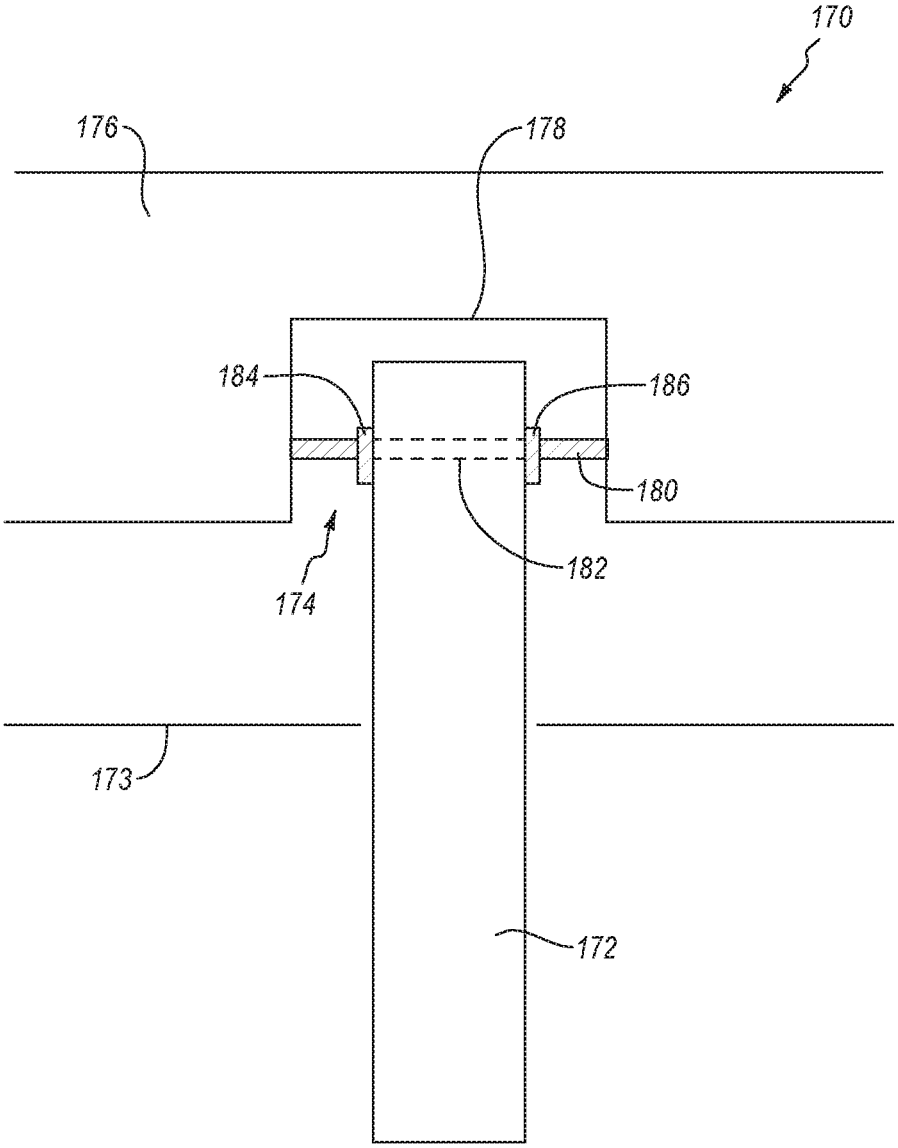
FIG. 4 illustrates an end-sectional view of a second securing mechanism according to an implementation of the present invention.

FIG. 4 illustrates another adjustment mechanism according to an implementation of the present invention. Architectural wall system 170 includes a wall 172 and an adjustment mechanism 174. A portion of wall 172 extends above a suspended ceiling 173 and into a channel 178 in a ceiling 176. The adjustment mechanism 174 comprises a threaded member 180, which is secured within channel 178. Specifically, threaded member 180 is secured to opposing lateral sides of channel 178. Threaded member 180 extends through an appropriately sized hole 182 in wall 172. Adjustment mechanism 174 also includes two nuts or securing members 184 and 186, which include threaded holes that are sized and shaped to interact with the threads on threaded member 180. Nuts 184 and 186 may be selectively moved along threaded member 180 and relative to ceiling 176 by rotating nuts 184 and 186 in appropriate respective directions.

Wall 172 may be secured in place by pinching wall 172 between nuts 184 and 186. In addition, as with adjustment mechanism 154, the position of wall 172 may be adjusted with respect to ceiling 176. For example, by rotating the nuts 184 and 186 in a first direction, wall 172 may be moved to a left side of channel 178. By rotating the nuts 184 and 186 in an opposite direction, wall 172 may be moved to a right side of channel 178. Thus, any pitch or non-vertical angle in wall 172 may be corrected.

Referring back to FIG. 1, architectural wall system 100 includes a support member 106 near the bottom edge of wall 102. Support member 106 may be secured to the portion of wall 102 that extends below the raised floor 116. Support member 106 may be securable to one or both sides of wall 102, and/or to the bottom surface of wall 102. Any suitable adhesive or mechanical securing mechanism may be used to secure support member 106 to wall 102. A single elongated support member may extend the length of the bottom edge of a wall. Alternatively, one or more support members may be positioned intermittently along the bottom edge of a wall.

A bottom surface of support member 106 can rest on or be attached to the floor 110 (such as by bolts, adhesives, and/or any other appropriate or suitable attachment member or fastener). The bottom side of support member 106 may include a textured pattern to increase the coefficient of friction and prevent slippage of support member 106 and wall 102 relative to floor 110. For example, the bottom side of support member 106 may include, spikes, a checkered pattern, and/or a series of lines that may help to prevent support member 106 from slipping on or along floor 110. Support member 106 may be made from any suitable material including rubber, plastic, wood, and/or metal. In some implementations, support member 106 may have one or more layers of another material that contacts a floor. For example, a layer of another material may have a higher coefficient of friction and may help to prevent the support member from slipping. Specifically, metal support members may have a layer of rubber that contacts a floor to help to prevent slipping.

In at least one implementation, an adjustment mechanism may include one or more support members. In particular, because a support member 106 may allow the wall 102 to be adjusted in position relative to a permanent structure, support member 106 may be part or a component of the adjustment mechanism.

Figure 5A:
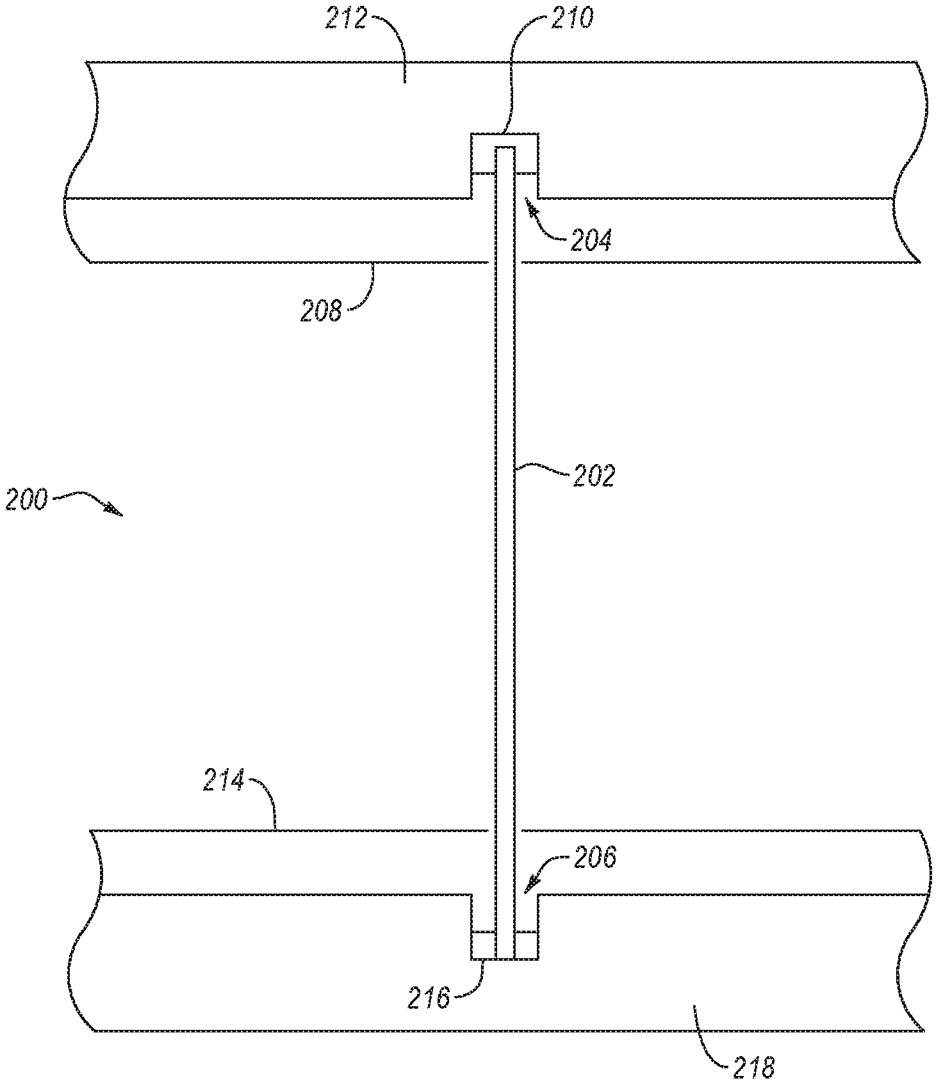
FIG. 5A illustrates an end view of another architectural wall and securing mechanism according to an implementation of the present invention.

In alternative implementations of the present invention, an architectural wall system may have multiple adjustment mechanisms. For example, FIG. 5A illustrates another architectural wall system 200 according to the present invention. Architectural wall system 200 includes a wall 202, a first adjustment mechanism 204, and a second adjustment mechanism 206. At its top end, wall 202 extends through an opening or aperture in a suspended ceiling 208 and into a channel 210 in a ceiling 212 Channel 210 includes the first adjustment mechanism 204, which secures a top end of wall 202 to ceiling 212. First adjustment mechanism 204 also allows the horizontal position of the top portion of wall 202 within channel 210 to be adjusted relative to ceiling 212. Thus, a vertical positioning of wall 202 may be achieved via first adjustment mechanism 204.

At its bottom end, wall 202 extends through an opening or aperture in a raised floor 214 and into a channel 216 in a floor 218. Channel 216 includes the second adjustment mechanism 206, which secures a bottom end of wall 202 to floor 218. Second adjustment mechanism 206 also allows the horizontal position of the bottom portion of wall 202 within channel 216 to be adjusted relative to floor 218. Thus, adjustment mechanisms 204 and 206 may allow a person to adjust the position and/or positioning of wall 202 to ensure that it is positioned substantially vertically. The first and second adjustment mechanisms 204, 206 and their components and elements can be similar to or the same as the adjustment mechanisms 104, 154, 174 described herein and illustrated in FIGS. 1-4.

Figure 5B:
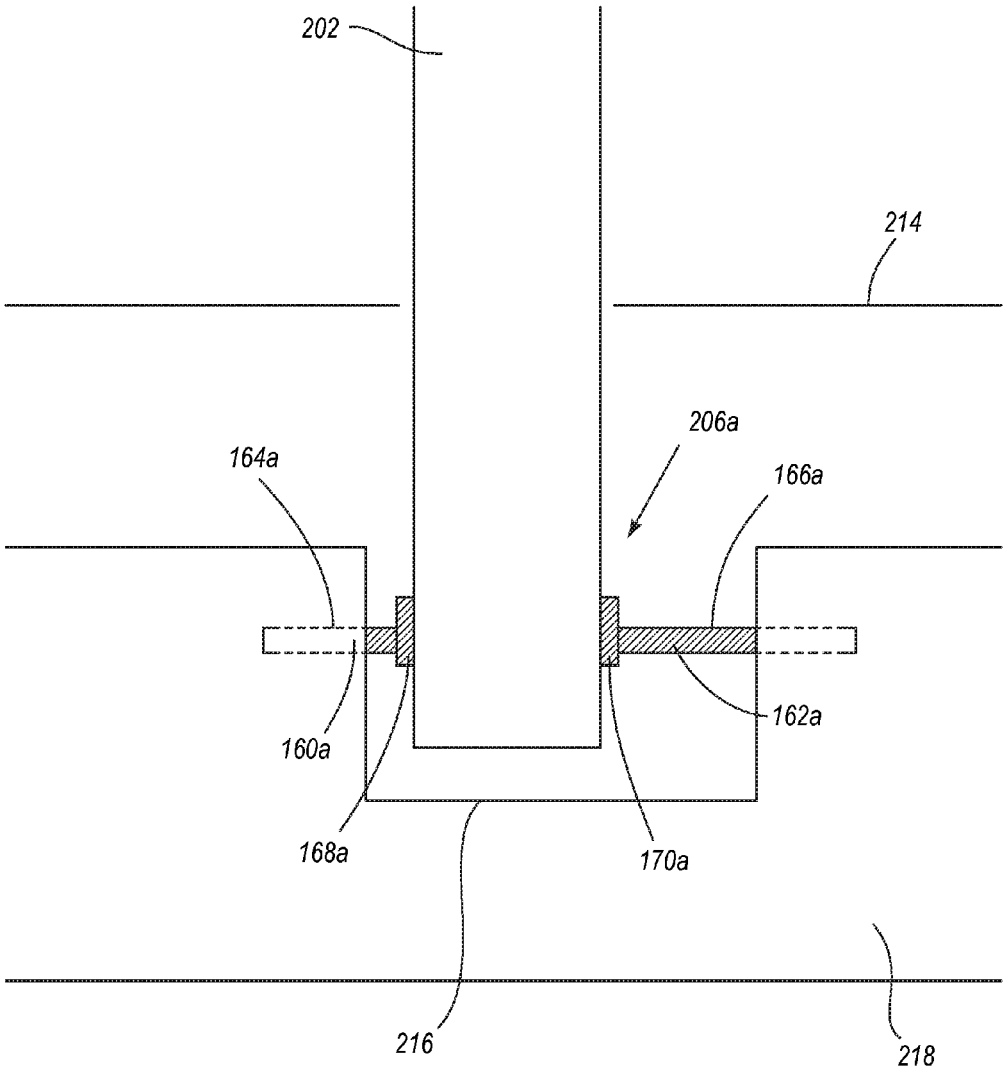
FIG. 5B illustrates the end view of FIG. 5A, further showing an end-sectional view of a floor-level securing mechanism in accordance with an implementation of the present invention.
Figure 5C:
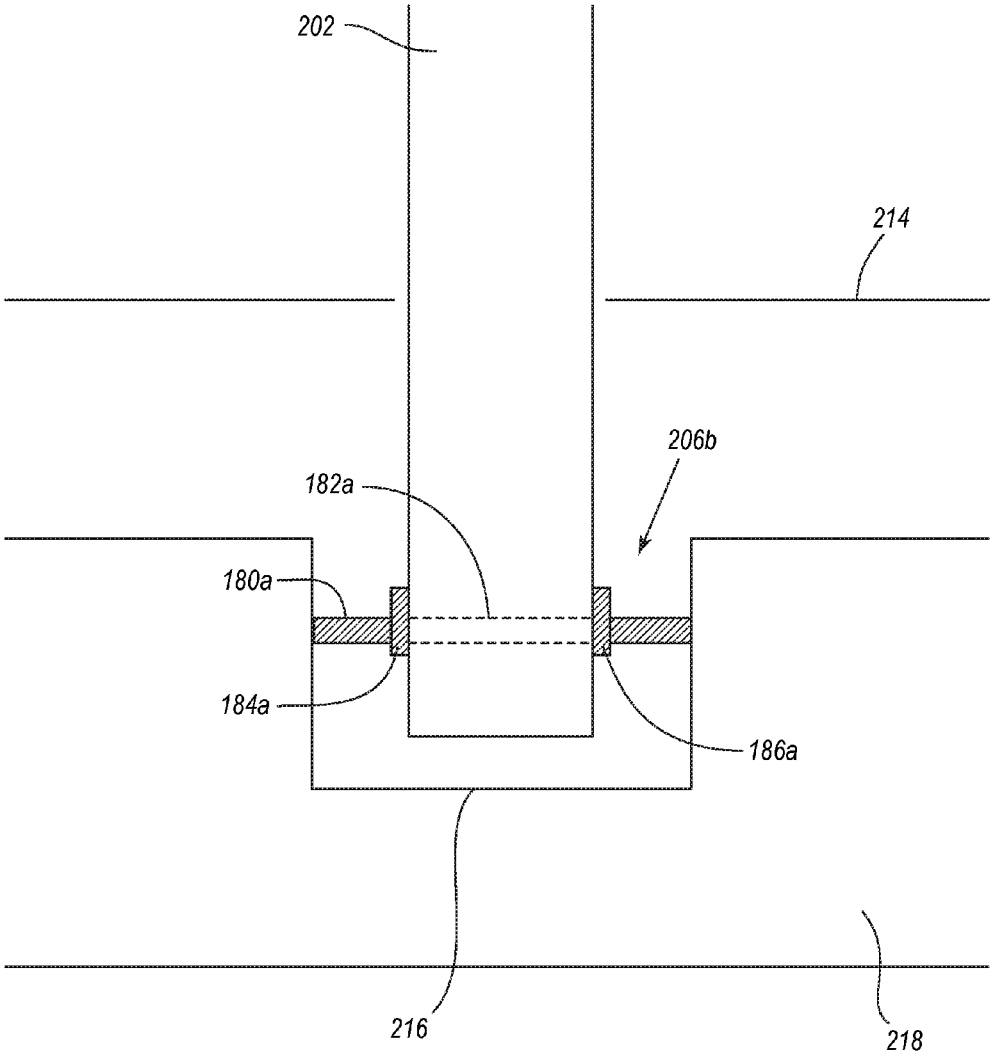
FIG. 5C illustrates the end view of FIG. 5A, further showing an end-sectional view of another floor-level securing mechanism in accordance with an implementation of the present invention.
Figure 5D:
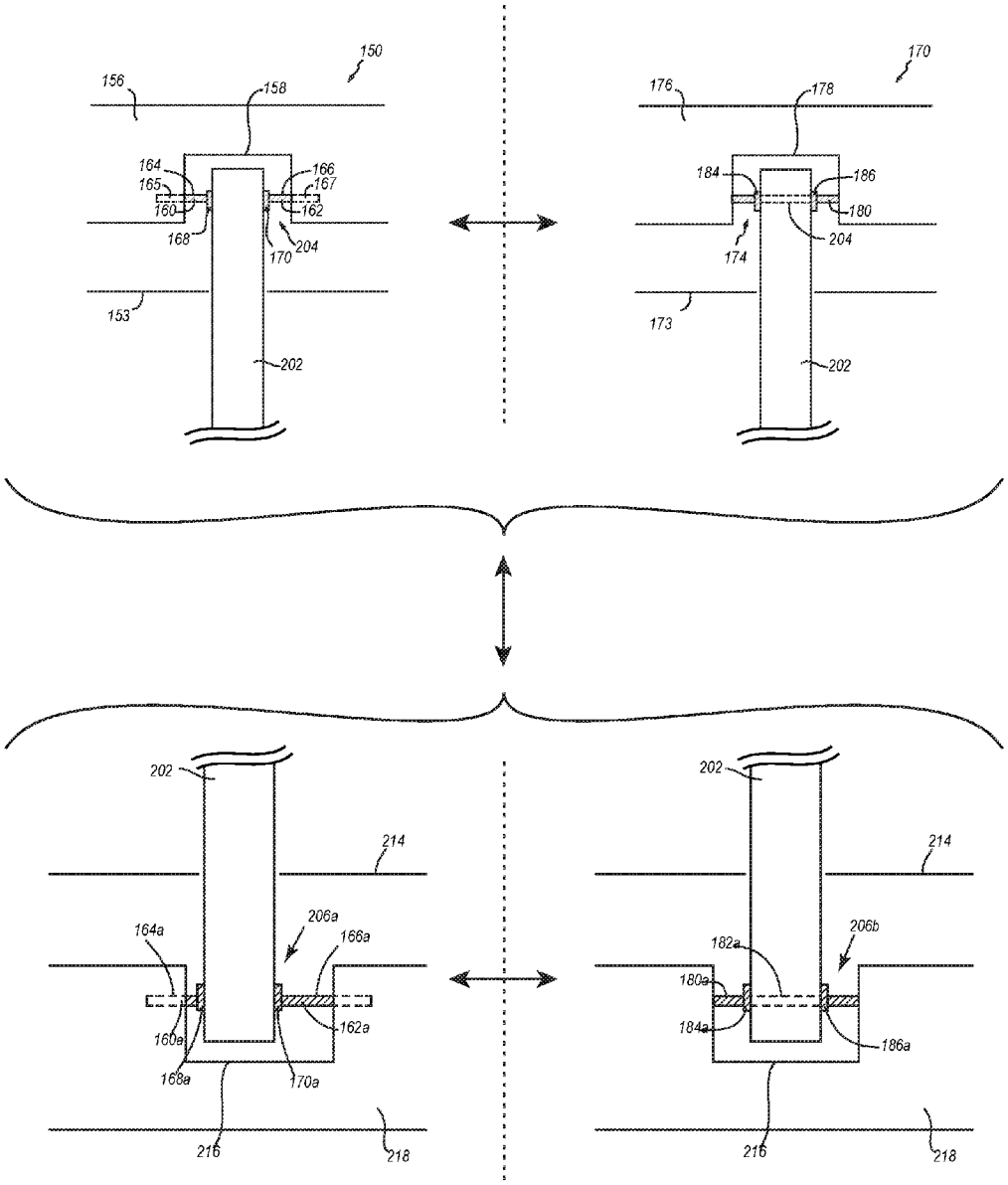
FIG. 5D illustrates the end view of FIG. 5A, further showing alternate end-sectional view combinations of both ceiling and floor-level securing mechanisms in accordance with one or more implementations of the present invention.

For example, FIG. 5B illustrates the architectural wall system of FIG. 5A, albeit shown with details of the second adjustment mechanism 206*a* adapted from adjustment mechanism 154 of FIG. 3A. In particular, FIG. 5B shows that the second adjustment mechanism 206*a* can employ multiple rotatable members in the form of first and second threaded portions 164*a*, 166*a* of screws 160*a* and 162*a*. FIG. 5B further shows that, like FIG. 3A, the second adjustment mechanism 206*a* also employs support portions 168*a*, 170*a* within channel 216. Similarly, FIG. 5C illustrates that the architectural wall system of FIG. 5A can employ alternate second adjustment mechanism 206*b* adapted from mechanism 174 of FIG. 4. In particular, FIG. 5C shows that, like FIG. 4, second adjustment mechanism 206*b* can employ a rotatable members comprising threaded member 180*a*, which is rotatably secured to nuts/support members 184*a* and 186*a*. FIG. 5D further highlights the interchangeability of the various, previously described adjustment mechanisms at both the ceiling and floor locations.

Figure 6:
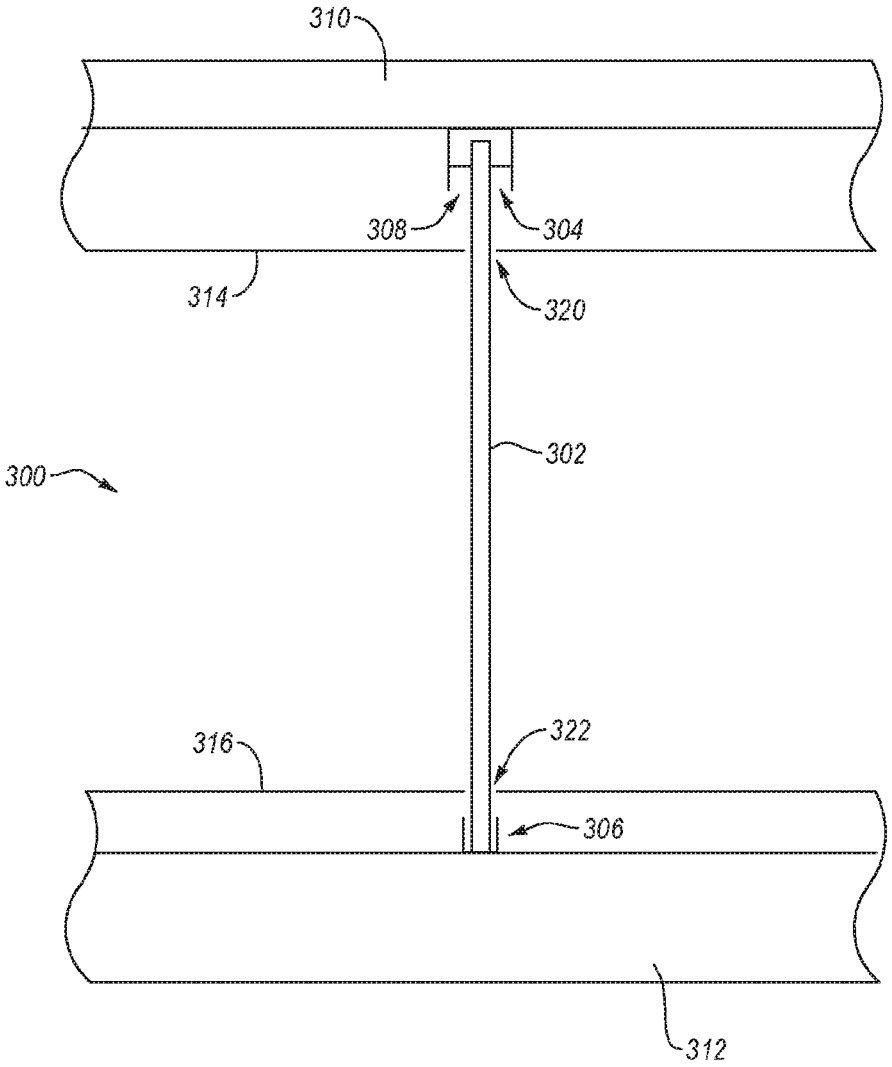
FIG. 6 illustrates an end view of yet another architectural wall and securing mechanism according to an implementation of the present invention

In alternative implementations of the present invention, a wall may be mounted to a floor and/or ceiling without the need for channels to be cut out of the floor and/or ceiling. Such a system is illustrated in FIG. 6. Specifically, FIG. 6 illustrates an end view of a secure architectural wall system 300. Architectural wall system 300 includes a wall 302, a first u-shaped track 304, a second u-shaped track 306, and an adjustment mechanism 308. One will appreciate, however, that tracks may comprise or be formed in or as any suitable shape, and that the present disclosure is not limited to u-shaped tracks.

The wall 302 extends above a drop down ceiling 314, through an appropriately sized hole, opening, or aperture 320 in the drop down ceiling. For example, the drop down ceiling 314 may include a rectangular aperture that has approximately the same dimensions as the wall 302 so that no significant gaps between the drop down ceiling 314 and the wall 302 exist. The wall 302 also extends below raised floor 316, through an appropriately sized hole, opening, or aperture 322 in the raised floor. For example, the raised floor 316 may include a rectangular aperture that has approximately the same dimensions as the wall 302 so that no significant gaps between the raised floor 316 and the wall 302 exist. In an alternative implementation, however, an appropriately sized gap or gaps may exist between the wall and the aperture(s) 320, 322.

First and second u-shaped tracks 304 and 306 are secured to a ceiling 310 and a floor 312, respectively. U-shaped tracks 304 and 306 may include two panels that extend away from ceiling 310 and 312, respectively, and which may be positioned substantially parallel with wall 302. U-shaped track 304 encloses at least partially the adjustment mechanism 308. As described herein above, adjustment mechanism 308 may be any mechanism that secures wall 302 to ceiling 310. For instance, adjustment mechanism 308 and its components and elements can be similar to or the same as the adjustment mechanisms 104, 154, 174, 204, 206 described herein and illustrated in FIGS. 1-5. Adjustment mechanism 308 may also allow selective adjustment to the horizontal and/or vertical position and/or positioning of the wall 302 (or upper portion thereof) within u-shaped track 304 to ensure that wall 302 is positioned appropriately and/or substantially vertically.

U-shaped track 306 may not include an adjustment mechanism. Rather, u-shaped member 306 may secure wall 302 to floor 312 via the panels that extend upward away from floor 312 and/or parallel to wall 302. In alternative implementations, a u-shaped track that secures a wall to a floor may include an adjustment mechanism. U-shaped tracks 304 and 306 may extend the entire length of wall 302 or only a portion or portions thereof.

Figure 7:
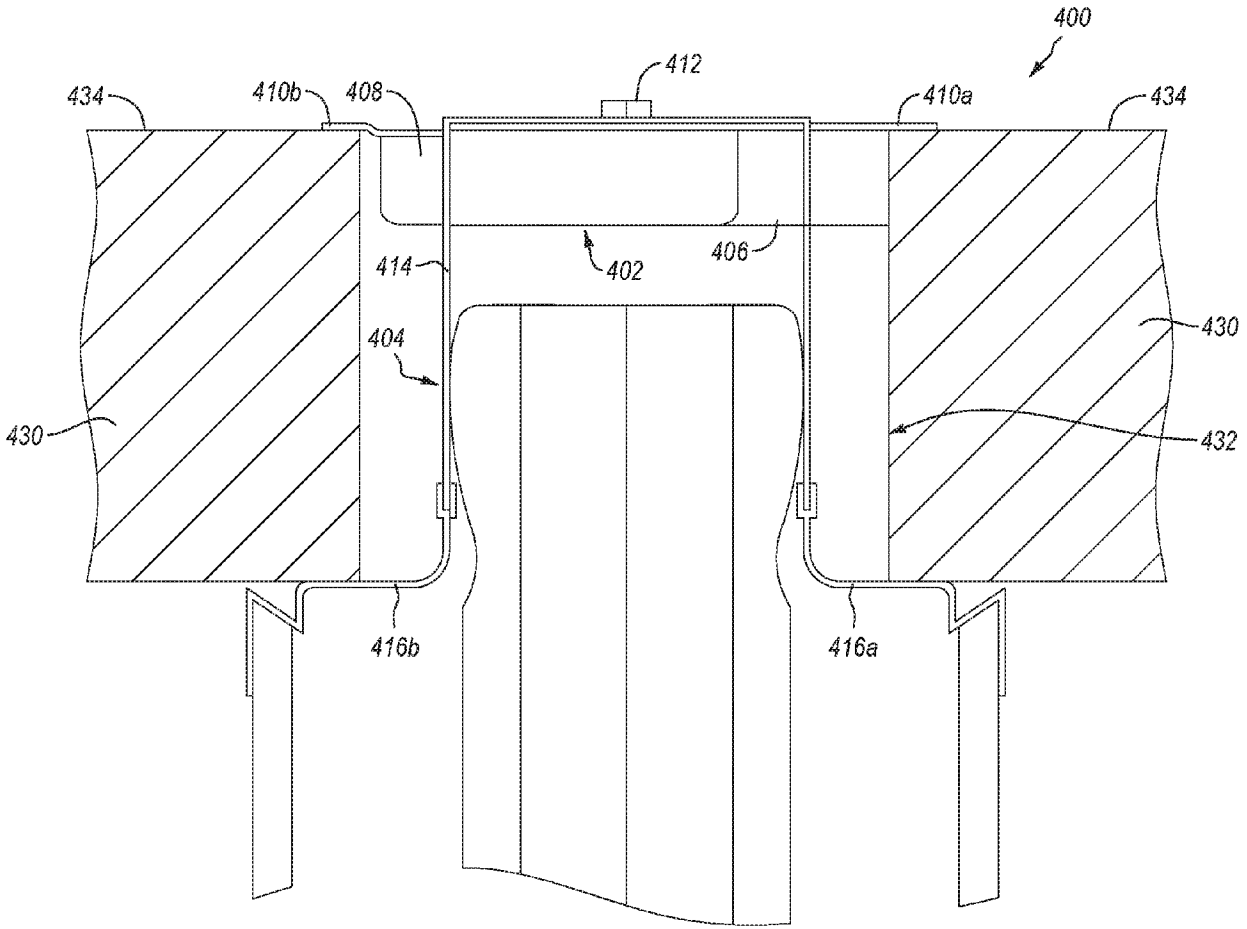
FIG. 7 illustrates an end view of a connection system with which an adjustment mechanism of the present invention may be utilized in accordance with an implementation of the present invention.
Figure 8:
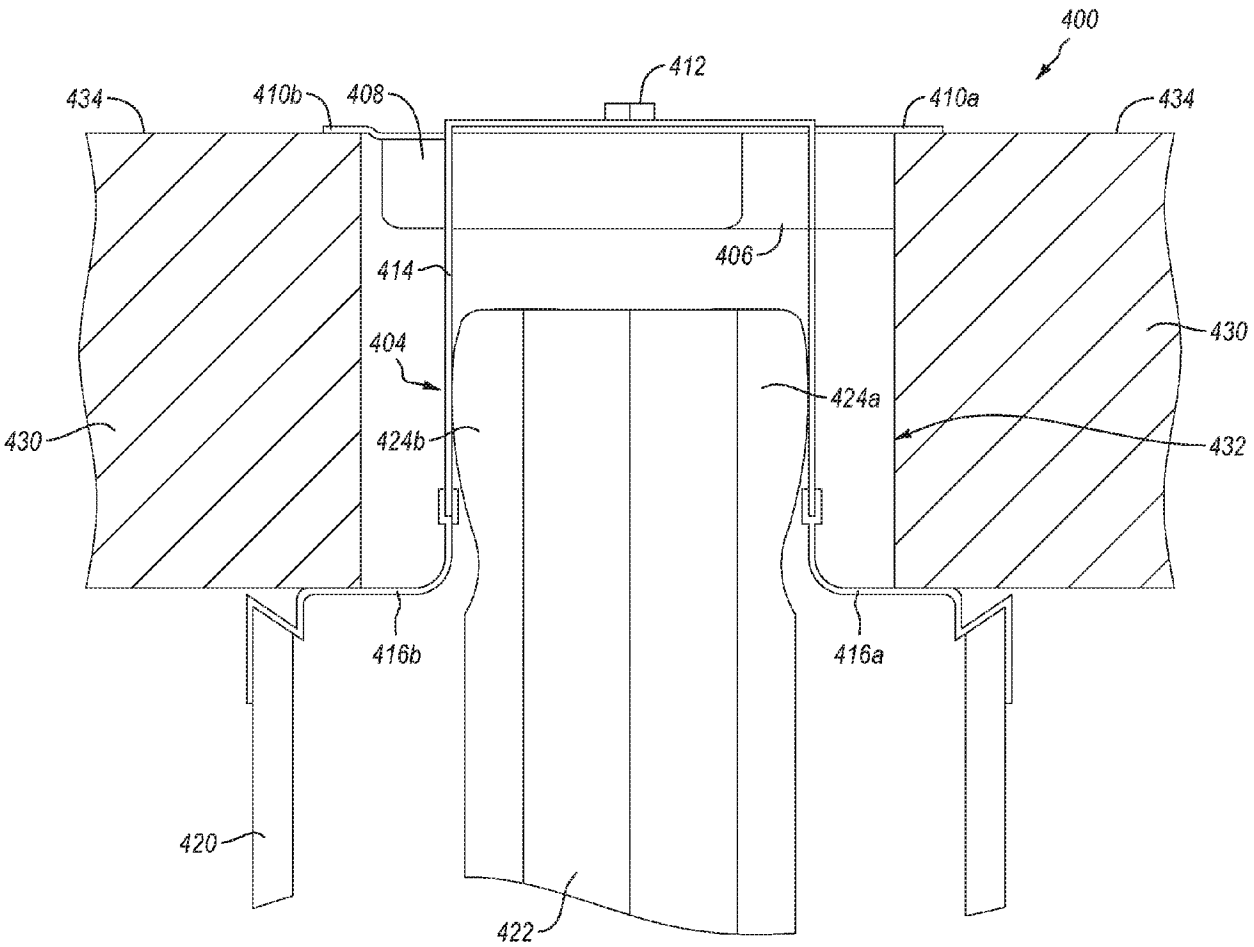
FIG. 8 illustrates another view of the connection system of FIG. 7.

FIGS. 7 and 8 illustrate another implementation of hardware for securing a wall within a channel with an adjustment mechanism. Particularly, FIGS. 7 and 8 illustrate a connection assembly 400 connecting or coupling a wall to a structural component of a building (e.g., to a ceiling 430). For example, the ceiling 430 can have a channel or a slot 432 as described above. In some instances, the ceiling 430 can have a recessed slot 432. Alternatively, the ceiling 430 can have a protruding slot 432. In still further implementations, the slot 432 can comprise a bracket secured to the ceiling 430. In any event, the ceiling 430 can have the slot 432 that can accept the upper end of a wall 422.

As shown, the connection assembly 400 can include a support assembly 402 and a bracket 404 secured to the support assembly 402. More specifically, the support assembly 402 can have a first member 406 and a second member 408. The second member 408 can slidably house the first member 406 in a manner that allows the first member 406 to move laterally relative to the second member 408. Consequently, the builder can adjust the distance between the respective ends of the first member 406 and the second member 408 to correspond with a particular width of the slot 432.

Furthermore, the support assembly 402 can have support tabs 410*a*, 410*b*, which can secure the support assembly 402 to the ceiling 430. For example, first member 406 can have the support tab 410*a* and the second member 408 can have the support tab 410*b*. Hence, the builder can set the support tabs 410*a*, 410*b* on an upper surface 434 of the ceiling 430, while at least a portion of the first member 406 and/or of the second member 408 protrudes into the slot 432.

Additionally, the support assembly 402 can include one or more fasteners 412, which can secure the first member 406 to the second member 408. In other words, after sliding the second member 408 and the first member 406 to a desired width (e.g., corresponding with the slot 432), the builder can fasten the second member 408 and the first member 406 together with the fastener(s) 412. For instance, the fastener 412 can comprise a bolt and a nut. It should be noted, however, that the fastener 412 can vary from one implementation to the other. Furthermore, in light of this disclosure, those skilled in the art should appreciate that the support assembly 402 can have various configurations, which can allow the builder to secure the support assembly 402 to the ceiling 430 and/or within the slot 432.

In at least one implementation, the second member 408 and/or the first member 406 can have a slot that accepts the fastener 412. Accordingly, the fastener 412 can be partially engaged (e.g., the bolt may have a hand-tight nut thereon), and the fastener 412 can move along the slot, relative to the first member 406 and/or second member 408. Similarly, the first member 406 and the second member 408 can move relative to each other when the fastener 412 is partially engaged.

The fastener 412 also can secure the bracket 404 to the support assembly 402. Likewise, the bracket 404 together with the fastener 412 can slide along the slot in the first member 406 and/or the second member 408 and, thus, along the support assembly 402. As noted above, a portion of the wall can rigidly connect to the building's structural component. For instance, a bottom end of the wall can connect to the floor of the building.

In some instances, the building can have a raised floor, and the wall can couple to a concrete floor below the raised floor of the building, as described above. Consequently, the raised floor may have slots or channels therein to accommodate at least a portion of the wall passing therethrough and connecting to the concrete floor below. The slots or channels in the raised floor may be misaligned with the slot 432 and the ceiling 430. Therefore, an adjustment mechanism such as those described above can allow the bracket 404 to move along the support assembly 402, and thereby move within the slot 432, allowing the builder to properly align and vertically position and secure the wall or a portion thereof within the slot 432. In other words, an adjustment mechanism can provide movement of the fastener 412 and/or of the bracket 404 relative to the support assembly 402, and the resulting movement of the bracket 404 relative to the slot 432, can accommodate installation of the wall where the slot 432 is misaligned with the slots or channels in the suspended floor.

In one or more implementations, the adjustment mechanism (not shown in FIGS. 7 and 8) can be positioned between each side of the bracket 404 and the wall 430. In any event, the adjustment mechanism can allow an installer to selectively move or position the bracket 404 within the channel or slot 432 to ensure proper or desired alignment of a wall to be positioned with the bracket 404. In still further implementations, the adjustment mechanism can be integrated into the support assembly 402. For instance, the adjustment mechanism and its components and elements can be similar to or the same as the adjustment mechanisms 104, 154, 174, 204, 206, 308 described herein and illustrated in FIGS. 1-6.

In at least one implementation, the connection assembly 400 can include one or more panels 420 coupled to a frame 416*b*, 416*b*. In certain implementations, the frame 416*a*, 416*b* may be coupled to the bracket and/or a portion, feature, or channel thereof. As described above, the bracket 404 can couple the wall to the ceiling 430. For example, the bracket 404 can include a U-shaped channel 414, which can accept and secure a portion of the wall. Particularly, the U-shaped channel 414 can secure a top end 422 of the wall.

For instance, the top end 422 can have substantially the same width as the U-shaped channel 414. Thus, the U-shaped channel 414 can frictionally secure the top end 422, thereby restricting or preventing movement of the top end 422 (and of the wall) relative to the bracket 404 and to the ceiling 430. Particularly, the U-shaped channel 414 and the top end 422 can have a press fit (or an interference fit) connection, which can provide sufficient force to restrain the wall from moving relative to the ceiling 430 (e.g., absent a seismic event).

Moreover, the top end 422 can have an at least partially spherical or a rounded shape. In one implementation, the top end 422 can have rounded faces 424*a*, 424*b*. As such, the top end 422 can rotate and/or pivot within the U-shaped channel 414. One will appreciate, however, the bracket 404 can include a channel 414 that has other than a U-shape without departing from the scope of this disclosure. Furthermore, other methods of securing or coupling the wall to the ceiling or other structural element, including clips, hooks, clamps, or other fasteners, are contemplated herein.

In the event that the slot 432 and slots or channels in the suspended floor are misaligned, the builder can move the frame 416*a*, 416*b*, together with (or independent of) the bracket 404, within the slot 432 to compensate for such misalignment. After the builder places the frame 416*a*, 416*b*, the bracket 404, and/or the channel 414 into proper and/or desired alignment, the builder can engage or tighten the fastener 412, to complete the installation of the top end 422 within the slot 432.

The adjustment mechanism(s) described above and shown in the figures each include an adjustment mechanism including a screw and nut configuration for providing adjustment. One will appreciate in light of the disclosure herein that the present invention is not so limited. For example, in one or more alternative implementations the adjustment mechanism can comprise a spring-loaded bar with set adjustment positions. In still further implementations, the adjustment mechanism can comprise an automated adjustment mechanism that an installer can remotely control, such as a screw and nut configuration with a motor for automatically turning the nut or bolt. In any event, the adjustment mechanism can allow an installer to adjust the position of a wall, or hardware that supports a wall, within a channel to allow for a desired alignment of the wall.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. An architectural wall system comprising:

a wall with at least a first face side and a second face side; and a first adjustment mechanism attached between the first face side of a first end of the wall and a first permanent structure, and a second adjustment mechanism attached between the second face side of the first end of the wall and the first permanent structure that allows the wall to be adjusted in position relative to the permanent structure;

wherein:

the first adjustment mechanism comprises a first rotatable member that is rotatable to adjust a position of the first end of the wall, the first rotatable member including a first support portion on at least one end thereof that interfaces directly with the first face side of the first end of the wall;

the second adjustment mechanism comprises a second rotatable member that is rotatable to adjust the position of the first end of the wall, the second rotatable member including a second support portion on at least one end thereof that interfaces directly with the second face side of the first end of the wall;

the first and second adjustment mechanisms are attached between the first end of the wall and the first permanent structure, and pinch the wall therebetween;

the wall is further secured at a second end opposed to the first end thereof to a second permanent structure;

a third adjustment mechanism is attached between the second end of the wall and the second permanent structure;

the second permanent structure includes at least one opening configured to receive a portion of a third rotatable member of the third adjustment mechanism; and the third rotatable member of the third adjustment mechanism rotates to adjust the position of the second end of the wall.

2. The architectural wall system as recited in claim 1, wherein at least a portion of the first and second adjustment mechanisms are positioned within a channel associated with the first permanent structure.

3. The architectural wall system as recited in claim 2, wherein the first and second adjustment mechanisms are secured to first and second opposing side walls of the channel, respectively.

4. The architectural wall system as recited in claim 1, wherein the first and second adjustment mechanisms:

secure the first end of the wall to the first permanent structure; and allow for selective adjustment of the wall relative to the first permanent structure by allowing a second end of the wall to be selectively adjusted horizontally such that the wall is positionable in a substantially vertical orientation.

5. The architectural wall system as recited in claim 1, wherein the first and second adjustment mechanisms further allow the first end of the wall to be selectively adjusted horizontally such that the wall is positionable in a substantially vertical orientation.

6. The architectural wall system as recited in claim 1 further comprising at least one support member configured to secure at least a portion of the wall to the second permanent structure.

7. The architectural wall system as recited in claim 1, wherein:

the first rotatable member is rotatable to adjust the position of the first end of the wall in a first direction;

rotating the first rotatable member in a first rotational direction adjusts the first end of the wall in the first direction, and the second rotatable member is rotatable to adjust the position of the first end of the wall in a second direction;

rotating the second rotatable member in a second rotational direction adjusts the first end of the wall in the second direction, and the first and second rotatable members cooperate to secure the wall therebetween.

8. The architectural wall system as recited in claim 7, wherein:

rotating the first rotatable member in the second rotational direction permits the first end of the wall to be adjusted in the second direction via rotating the second rotatable member in the second rotational direction; and rotating the second rotatable member in the first rotational direction permits the first end of the wall to be adjusted in the first direction via rotating the first rotatable member in the first rotational direction.

9. The architectural wall system as recited in claim 1, wherein one or more of the first or second rotatable members are configured to be secured at least partially within one or more openings in the first permanent structure.

10. The architectural wall system as recited in claim 1, wherein:

the first adjustment mechanism comprises a first threaded member for securing the first end of the wall to the first permanent structure, and the second adjustment mechanism comprises a second threaded member for securing the first end of the wall to the first permanent structure.

11. The architectural wall system as recited in claim 10, wherein rotating the first rotatable member in the second rotational direction permits the first end of the wall to be adjusted in the second direction via rotating the second rotatable member in the second rotational direction, and wherein rotating the second rotatable member in the first rotational direction permits the first end of the wall to be adjusted in the first direction via rotating the first rotatable member in the first rotational direction.

12. An architectural wall system comprising:

a wall, comprising:

a first side;

a second side disposed opposite the first side; and a hole disposed at a first end of the wall, the hole extending from the first side to the second side; and an adjustment mechanism associated with the wall and a permanent structure and operable to adjust a position of the wall relative to the permanent structure, the adjustment mechanism comprising:

a threaded member attached to the permanent structure and spanning the hole;

a first support portion associated with the threaded member and interfacing directly with the first side of the wall; and a second support portion associated with the threaded member and interfacing directly with the second side of the wall, wherein the first and second support portions pinch the wall therebetween, and wherein rotating the first and second support portions about the threaded member adjusts the position of the wall relative to the permanent structure.

13. The architectural wall system as recited in claim 12, wherein:

rotating the first support portion in a first rotational direction and the second support portion in a second rotational direction permits the first end of the wall to be adjusted in a first direction; and rotating the second rotatable member in the first rotational direction and rotating the first support portion in the second rotational direction permits the first end of the wall to be adjusted in a second direction.

* * * * *